US012270295B2

(12) United States Patent
Pollock et al.

(10) Patent No.: US 12,270,295 B2
(45) Date of Patent: Apr. 8, 2025

(54) CONTROLLER FOR USE WITH A REMOTE DOWNHOLE TOOL

(71) Applicant: Expro North Sea Limited, Aberdeen (GB)

(72) Inventors: David Pollock, Southampton (GB); Alexandra Vasil'Evna Rogacheva, Southampton (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 18/009,928

(22) PCT Filed: Jun. 10, 2021

(86) PCT No.: PCT/EP2021/065730

§ 371 (c)(1),
(2) Date: Dec. 12, 2022

(87) PCT Pub. No.: WO2021/250223

PCT Pub. Date: Dec. 16, 2021

(65) Prior Publication Data

US 2023/0220766 A1 Jul. 13, 2023

(30) Foreign Application Priority Data

Jun. 11, 2020 (GB) ..... 2008909

(51) Int. Cl.
*E21B 47/12* (2012.01)

(52) U.S. Cl.
CPC ..... *E21B 47/12* (2013.01)

(58) Field of Classification Search
CPC ..... E21B 47/12; E21B 47/125; E21B 47/13; E21B 47/14; E21B 47/16; E21B 47/18; E21B 47/20; E21B 47/22; E21B 47/24; E21B 47/26
See application file for complete search history.

(56) References Cited

U.S. PATENT DOCUMENTS

| | | | | |
|---|---|---|---|---|
| 9,982,528 | B2 * | 5/2018 | Recio | H04Q 9/00 |
| 10,358,883 | B2 * | 7/2019 | Thomas | E21B 43/11 |
| 2007/0057811 | A1 | 3/2007 | Mehta | |
| 2014/0240141 | A1 | 8/2014 | Logan | |
| 2019/0007159 | A1 * | 1/2019 | Dufour | E21B 47/12 |

FOREIGN PATENT DOCUMENTS

WO 2019108184 A1 6/2019

* cited by examiner

*Primary Examiner* — Franklin D Balseca
(74) *Attorney, Agent, or Firm* — Getz Balich LLC

(57) ABSTRACT

A controller for use with a remote downhole tool is provided. The controller includes a processor and a transmitter for transmission of control signals to the remote downhole tool. The controller is configured for use at surface or uphole of the remote downhole tool to control transmission of data from the remote downhole tool. The controller is configured to transmit a control signal to the remote downhole tool to configure the remote downhole tool for transmission of data from the remote downhole tool according to a schedule or on demand. A communication system for use in a downhole environment is also provided. Methods of managing data transmission of a remote downhole tool are also provided.

18 Claims, 3 Drawing Sheets

CONTROLLER FOR USE WITH A REMOTE DOWNHOLE TOOL

This application claims priority to PCT Patent Appln. No. PCT/EP2021/065730 filed Jun. 10, 2021, which claims priority to Great Britain Patent Appln. No. 2008909.0 filed Jun. 11, 2020, which are hereby incorporated herein by reference in their entireties.

BACKGROUND OF THE INVENTION

1. Technical Field

The subject application generally relates to communication systems in the oil and gas industry, and specifically to a controller for use with a remote downhole tool. The application may relate to controlling transmission of data from the remote downhole tool, the associated downhole tool, the combined communication system and/or a method of managing data transmission of a remote downhole tool via a controller.

2. Background Information

Downhole tools, devices or gauges are placed in oil and gas wells, and used to obtain measurements for transmittal to the surface. Typically downhole gauges take measurements of variables such as temperature and pressure for monitoring conditions within the well. Such measurements are used by well operators to maintain appropriate operation of the well or during well intervention processes.

Data comprising these measurements are transmitted wirelessly and/or via wired connection between a gauge and the surface. Wireless transmission allows for communication to be maintained whilst a gauge is in-hole without requiring dedicated cabling such as wireline. Technologies such as the applicant's own CaTS™ system may be used to transmit data using electromagnetic waves between a downhole gauge and the surface by utilizing well tubing, structures, or casing as a transmission medium. Alternatively data may be transmitted using other wireless methods such as (but not limited to) by acoustic signals or with flow modulation techniques.

Downhole gauges may be powered by wired connection to the surface and/or one or more downhole batteries. Data communication to and/or from the downhole gauges may not be possible if battery power is partially or fully depleted.

In addition, multiple downhole gauges may be present in a single wellbore. As such uphole and/or surface receiving units may not be able to discern which downhole gauge has transmitted particular data. Information may be lost, well performance may be inefficient and safety of the well may be comprised.

This background serves only to set a scene to allow a person skilled in the art to better appreciate the following description. Therefore, none of the above discussion should necessarily be taken as an acknowledgement that that discussion is part of the state of the art or is common general knowledge. One or more aspects/embodiments of the disclosure may or may not address one or more of the background issues.

SUMMARY

According to an aspect of the disclosure there is provided a controller for use with a remote downhole tool for controlling transmission of data from the remote downhole tool.

The control of transmission of data from the remote downhole tool by the controller ensures that data, such as measurements made by the downhole tool, are transmitted as and when needed. Further, the remote downhole tool may have less logic and/or electronics than conventionally required for the downhole tool to control transmission of data. As such, the remote downhole tool may have reduced power requirements compared to conventional downhole tools given the reduction in logic and/or electronics. If the remote downhole tool is battery powered, then the remote downhole tool may have a longer service life before battery replacement is required as the battery may power the downhole tool for a greater period of time and/or the remote downhole tool may be smaller than conventional downhole tools.

In some or more examples, the controller manages data retrieval from the remote downhole tool. In some or more examples, the remote downhole tool is located in a wellbore. In some or more examples, the remote downhole tool is located downhole of the controller.

In some or more examples, the controller comprises a processor and a transmitter for transmission of controls signals to the remote downhole tool. In some or more examples, the controller comprises a memory or data store. The memory or data store may store data received from the remote downhole tool. The processor may process data stored in the memory or data store. The processor may process data received from the remote downhole tool.

In some or more examples, the controller is configured for use at surface and/or uphole of the remote downhole tool. In some or more examples, the controller forms part of a subsea unit or a surface unit. In some or more examples, the controller is configured for use within the wellbore.

In some or more examples, the controller is configured to transmit a control signal to the remote downhole tool to configure the remote downhole tool for transmission of data from the remote downhole tool according to a schedule or on demand. The control signal may comprise data for configuring the downhole tool to transmit future data. That is, the control signal may configure the downhole tool to transmit data according to a schedule, e.g. at broadly periodic or regular intervals, or to transmit data in response to requests for data transmission. The controller may further configure the downhole tool to transmit data in response to an event at the downhole tool.

The event may be a power condition at the downhole tool, or a parameter at a threshold level. The power condition may be low power at one or more batteries powering the downhole tool. The parameter may be detected by the downhole tool. The parameter may be one or more pressure, temperature, strain, stress, resistivity, current, and voltage.

In some or more examples, the schedule comprises data transmission once every 24 hours, once every hour, or once every 3, 4 or 6 hours. Transmitting data according to schedule ensures that data collected by the remote downhole tool is transmitted to surface regularly. This may result in the remote downhole tool requiring smaller storage, e.g. memory storage, to store detected data as data is regularly transmitted from the remote downhole tool.

In some or more examples, the data is transmitted from the remote downhole tool to the controller. In some or more examples, the data is alternatively or additionally transmitted to an uphole or downhole unit. In some or more examples, the unit is located at the surface or is located at a subsea location, e.g. at the surface of the sea floor. In some or more examples, the unit is configured to collate and/or collect data from one or more remote downhole tools. In some or more examples, the unit is configured to control one or more downhole tools, valves, and a blowout preventer (BOPs) associated with a well based on data received from the remote downhole tool.

In some or more examples, the controller is configured to automatically or manually transmit the control signal to the remote downhole tool.

Automatic transmission may include transmission of the control signal in response to received data. In particular, the controller may be configured to transmit the control signal in response to a detected measurement. The measurement may be detected by the remote downhole tool and communicated to the controller. For example, the remote downhole tool may detect a parameter reaching a threshold, e.g. pressure downhole reaching a particular value. The remote downhole tool may communicate the detected/measured pressure to the controller. The controller may transmit a control signal to the remote downhole tool to configure the tool for transmission of data from the remote downhole tool according to the schedule or on demand based on the detected/measured pressure. Automatic transmission ensures that the downhole tool transmits data in the most efficient and optimal manner. For example, automatic transmission of a control signal to the remote downhole to configure the tool for transmission of data from the remote downhole according to a schedule may be most efficient and/or optimal during the production phase of a well lifecycle. Transmission of data on demand may be the most efficient and/or optimal during abandonment. Automatically transmitting control signals to change between transmitting on schedule and transmitting on demand may provide for optimal and/or efficient use of limited processing, battery and communication resources.

Manual transmission of the control signal may be controlled by an operator. The operator may be located on a well rig, well vessel or at a location remote from a well associated with the controller. Manual transmission of the control signal may allow for remote control of the controller which may reduce the personal required in the potentially dangerous location of the wellbore and may increase the safety of the wellbore.

In some or more examples, the controller is configured to transmit the control signal via wired or wireless communication. In some or more examples, the control signal is communicated downhole through tubing, casing, lining or another structure of the wellbore. The control signal may be communicated using electromagnetic or acoustic waves transmitting In some or more examples, the controller further comprises a receiver for reception of data from the remote downhole tool. In some or more examples, the receiver forms part of the controller while in other examples, the receiver is a separate unit from the controller. In some or more examples, the receiver receives data from the remote downhole tool communicated via wired or wireless communication. In some or more examples, the data is communicated through tubing, casing, lining or another structure of the wellbore.

Wired communication is through a guided transmission medium, such as a wire, other metallic structure or a material having high electromagnetic (EM) conductivity relative to a surrounding medium. Wired communication may utilize e-lines, slicklines, fiber optic cabling, etc. In some or more examples, wired communication utilizes electromagnetic technology, acoustic technology and/or pressure wave technology. Wireless communication is not through a guided transmission medium. Wireless communication is through air, water, ground (or formation) or another medium that has substantially isotropic EM conductivity. In some or more examples, wireless communication utilizes electromagnetic technology, acoustic technology and/or pressure wave technology.

In some or more examples, the receiver is configured to change between any of: reception of data from the remote downhole tool according to a schedule and on demand. The change in data reception may be automatic or manual.

For example, the receiver may be receiving data from the remote downhole tool every 24 hours for a period of several days while the well is in the production stage, but then change to receiving data from the remote downhole tool on demand when the well is post-production, e.g. abandoned.

In some or more examples, the receiver is configured to accept transmission from all downhole tools which the controller has transmitted a control signal to. The controller may therefore configure the receiver to accept transmissions of data from all downhole tools that the controller has transmitter has transmitted a control signal to. In particular, the controller may configure the receiver to accept transmissions of data from downhole tools which the controller has transmitted a control signal to transmit data according to a schedule.

In some or more examples, the receiver is multi-channel receiver. Each channel of the multi-channel receiver may be reserved for a particular downhole tool that the controller expects to receive data from, whether on a schedule or on demand.

In some or more examples, the controller is configured to control whether the remote downhole tool transmits data according to the schedule or on demand. The controller may communicate or transmit a control signal to the remote downhole tool to instruct the remote downhole tool to change data transmission from the schedule to on demand or vice a versa.

In some or more examples, the controller is configured to communicate or transmit a control signal to the remote downhole tool to request change of data transmission of data from the remote downhole tool between transmission according to the schedule or transmission on demand, or vice a versa. In some or more examples, the controller is configured to communicate or transmit the control signal in response to a detected measurement. In some or more examples, the measurement is detected downhole. The measurement may be detected by the remote downhole tool or a further remote downhole tool. The measurement may be communicated to the controller. The controller may be configured to manually or automatically communicate or transmit the signal. Automatic communication or transmission allows for faster and/or more efficient control of data transmission from the remote downhole tool. This ensures data is not lost and/or transmitted as needed, rather than waiting for operator input to manually send the control signal.

In some or more examples, the controller is configured to control transmission of data from a plurality of remote downhole tools. The controller may be configured to transmit control signals to the plurality of downhole tools. The remote downhole tools may all be located in a single wellbore or in multiple wellbores. Furthermore, the remote downhole tools may comprises a variety of remote downhole tools, e.g. pressure gauges, temperature gauges, packers, plugs, etc.

As previously described, in some or more examples, the controller comprises a processor and a transmitter. The controller may comprise a plurality of processors and/or a plurality of transmitters. The processors and/or transmitters may be located in various locations. A processor and/or transmitter may be located in each wellbore associated with the controller. The controller may be configured to control transmission of control signals to a plurality of remote downhole tools, with tools located in a plurality wellbores. As such, each processor and/or transmitter may be associated with a particular wellbore and transmit control signals to one or more remote downhole tools associated with that wellbore. The controller may comprise a master controller that controls the plurality of processors and/or transmitters which may form sub-controllers at each wellbore. The master controller and sub-controllers may have a master/slave communication and/or control scheme.

In some or more examples, the controller is configured to manage conflict between more than one remote downhole tool. In some or more examples, the controller is configured to manage conflict such that a conflict does not occur between multiple remote downhole tools. The conflict may be a communication conflict. The communication conflict may be due to the controller receiving data transmissions from multiple remote downhole tools and/or due to the controller transmitting control signals to multiple remote downhole tools.

When the controller receives data transmissions from multiple remote downhole tools, the controller may not be able to identify which remote downhole tool the data transmission is being transmitted from. As will be appreciated, data may be lost resulting in inefficient, unsafe, and/or sub-optimal performance and/or management of one or more wellbores. When the controller transmits control signals to multiple remote downhole tools, the remote downhole tools may not be able to identify which control signal is intended for a particular remote downhole tool. The remote downhole tools may accordingly not receive the request to transmit data from the remote downhole tool according to a schedule or on demand resulting in inefficient, unsafe, and/or sub-optimal performance and/or management of one or more wellbores.

In some or more examples, the controller is configured to at least one of: assign communication channels to the remote downhole tools; and time delay communication with the remote downhole tools. The controller may be configured to transmit a control signal to at least one remote downhole tool to assign a communication channel to the remote downhole tool. The controller may assign a separate channel to one or more remote downhole tools of the plurality of remote downhole tools to manage conflict. Each remote downhole tool which communicates with the controller, i.e. receives a control signal from the controller or transmits data to the controller, may be assigned a separate and/or unique communication channel. The communication channel may comprise a frequency or frequency range, a wavelength, a time range, and/or a particular wire/cable.

The controller may be configured to delay transmission of the control signal such that sufficient time has elapsed between transmission of temporally concurrent control signals to manage conflict. The controller may be configured to delay or schedule transmission of data from remote downhole tools such that sufficient time has elapsed between reception of temporally concurrent data to manage conflict.

In some or more examples, the controller is configured to implement channel spacing to manage conflict. The controller may be configured to assign a separate and unique channel to each remote downhole tool to which a control signal is transmitted. The channels may be sufficiently spaced such that conflicts may be managed.

According to another aspect of the disclosure there is provided a downhole tool for use with a controller.

In some or more examples, the downhole tool is located downhole of the controller. In some or more examples, the downhole tool is remote from the controller. In some or more examples, the controller is configured for use at surface and/or uphole of the remote downhole tool. In some or more examples, the controller forms part of a subsea unit or a surface unit. In some or more examples, the controller is configured for use within the wellbore.

In some or examples, the downhole tool is configured to transmit data to the controller. In some or more examples, the downhole tool is configured to transmit data in response to at least one of a control signal from the controller, an event at the downhole tool and on a schedule. The downhole tool may comprise a receiver configured to receive the control signal. The downhole tool may comprise a processor configured to control transmission of the data based on the received control signal. The received control signal may comprise data for configuring the downhole tool to transmit data to the controller according to a schedule, as a result of the event and/or on demand.

The control of transmission of data from the remote downhole tool by the controller ensures that data, such as measurements made by the downhole tool, are transmitted as and when needed. Further, the remote downhole tool may have less logic and/or electronics than conventionally required for the downhole tool to control transmission of data. As such, the remote downhole tool may have reduced power requirements compared to conventional downhole tools given the reduction in logic and/or electronics. If the remote downhole tool is battery powered, then the remote downhole tool may have a longer service life before battery replacement is required as the battery may power the downhole tool for a greater period of time and/or the remote downhole tool may be smaller than conventional downhole tools.

In some or more examples, the schedule comprises data transmission once every 24 hours, once every hour, or once every 3, 4 or 6 hours. Transmitting data according to schedule ensures that data collected by the remote downhole tool is transmitted to surface regularly. This may result in the remote downhole tool requiring smaller storage, e.g. memory storage, to store detected data as data is regularly transmitted from the remote downhole tool.

In some or more examples, the controller is configured to transmit a control signal.

In some or more examples, the data transmitted to the controller is additionally transmitted to an uphole or downhole unit. In some or more examples, the unit is located at the surface or is located at a subsea location, e.g. at the surface of the sea floor. In some or more examples, the unit is configured to collate and/or collect data from one or more remote downhole tools. In some or more examples, the unit is configured to control one or more downhole tools, valves, and a blowout preventer (BOPs) associated with a well based on data received from the remote downhole tool.

In some or more examples, the downhole tool is configured to transmit data signal via wired or wireless communication. In some or more examples, data is communicated downhole through tubing, casing, lining or another structure of the wellbore.

Wired communication is through a guided transmission medium, such as a wire, other metallic structure or a material having high electromagnetic (EM) conductivity relative to a surrounding medium. Wired communication may utilize e-lines, slicklines, fiber optic cabling, etc. Wireless communication is not through a guided transmission medium. Wireless communication is through air, water, ground (or formation) or another medium that has substantially isotropic EM conductivity. In some or more examples, wireless communication utilizes electromagnetic technology, acoustic technology and/or pressure wave technology.

In some or more examples, the downhole tool is configured to change between any of data transmission in response to the control signal, the event at the downhole tool and on the schedule. In some or more examples, the downhole tools changes between any of data transmission in response to the control signal, the event at the downhole tool and on the schedule in response to a control signal communicated from a controller. The control signal may instruct the downhole tool to discontinue communicating data according to the schedule and instead communicate data in response to an event. Alternatively, the control signal may instruct the downhole tool to discontinue communicating data in response to an event and instead communicate data according to the schedule.

In some or more examples, the control signal is communicated from the controller via wired or wireless communication. Wired and wireless communication may be as previously described.

In some or more examples, the event is a power condition at the downhole tool, or a parameter at a threshold level. The power condition may be low power at one or more batteries powering the downhole tool. The parameter may be detected by the downhole tool. The parameter may be one or more pressure, temperature, strain, stress, resistivity, current, and voltage.

In some or more examples, the downhole tool comprises a detector configured to detect a power level of at least one battery at the downhole tool. The battery is configured to power the downhole tool. Upon the detector detecting that the battery has reaching a power condition, such as a power level of the battery being below a threshold power level, the downhole tool may communicate data detected at the downhole tool. This ensures that data is not lost, but instead communicated prior to the downhole tool having insufficient power to communicate detected data.

In some or more examples, the downhole tool comprises logic and/or a processor to determine that the power condition at the downhole tool and/or determine if a parameter is at a threshold level.

In some or more examples, data comprises data collected by one or more sensors of the downhole tool. At least one of the sensor may detect one or more of pressure, temperature, strain, stress, resistivity, current, and voltage downhole.

In some or more examples, the schedule comprises data transmission at least once every 24 hours. In some or more examples, the schedule comprises data transmission once every hour, or once every 3, 4 or 6 hours. Transmitting data according to schedule ensures that data collected by the remote downhole tool is transmitted to surface regularly. This may result in the remote downhole tool requiring smaller storage, e.g. memory storage, to store detected data as data is regularly transmitted from the remote downhole tool.

According to another aspect of the disclosure there is provided a communication system for use in a downhole environment.

In some or more examples, the communication system comprises a controller for use with a remote downhole tool. In some or more examples, the controller comprises a processor and a transmitter. In some or more examples, the transmitter is for use at surface or uphole of the remote downhole tool to control transmission of data from the remote downhole tool. In some or more examples, the controller is configured to transmit a control signal to the remote downhole tool to configure the tool for transmission of data from the remote downhole tool according to a schedule or on demand. The controller may include any of the features, elements and/or benefits of the previously described controller.

The remote downhole tool may comprise a receiver for receiving the control signal. The remote downhole tool may comprise a processor configured to control transmission of data from the downhole tool based on the received control signal. The remote downhole tool is configured to transmit data to the controller. In some or more examples, the remote downhole tool is configured to transmit data in response the control signal from the controller, in event at the remote downhole tool and on the schedule. The remote downhole tool may include any of the features, elements and/or benefits of the previously described tool.

The control of transmission of data from the remote downhole tool by the controller ensures that data, such as measurements made by the downhole tool, are transmitted as and when needed. Further, the remote downhole tool may have less logic and/or electronics than conventionally required for the downhole tool to control transmission of data. As such, the remote downhole tool may have reduced power requirements compared to conventional downhole tools given the reduction in logic and/or electronics. If the remote downhole tool is battery powered, then the remote downhole tool may have a longer service life before battery replacement is required as the battery may power the downhole tool for a greater period of time and/or the remote downhole tool may be smaller than conventional downhole tools.

In some or more examples, the controller further comprises a receiver for reception of data from the remote downhole tool. In some or more examples, the receiver forms part of the controller while in other examples, the receiver is a separate unit from the controller. In some or more examples, the receiver receives data from the remote downhole tool communicated via wired or wireless communication. In some or more examples, the data is communicated through tubing, casing, lining or another structure of the wellbore. Wired and wireless communication may be as previously described.

In some or more examples, the receiver is configured to change between any of: reception of data from the remote downhole tool according to a schedule and on demand. The change in data reception may be automatic or manual.

For example, the receiver may be receiving data from the remote downhole tool every 24 hours for a period of several days while the well is in the production stage, but then change to receiving data from the remote downhole tool on demand when the well is post-production, e.g. abandoned.

In some or more examples, the receiver is configured to accept transmission from all downhole tools which the controller has transmitted a control signal to. The controller may therefore configure the receiver to accept transmissions of data from all downhole tools that the controller has transmitter has transmitted a control signal to. In particular, the controller may configure the receiver to accept transmissions of data from downhole tools which the controller has transmitted a control signal to transmit data according to a schedule.

In some or more examples, the receiver is multi-channel receiver. Each channel of the multi-channel receiver may be reserved for a particular downhole tool that the controller expects to receive data from, whether on a schedule or on demand.

In some or more examples, the controller is configured to control transmission of data from a plurality of remote downhole tools. The remote downhole tools may all be located in a single wellbore or in multiple wellbores. Furthermore, the remote downhole tools may comprises a variety of remote downhole tools, e.g. pressure gauges, temperature gauges, packers, plugs, etc.

In some or more examples, the controller is configured to manage conflict between more than one remote downhole tool. In some or more examples, the controller is configured to manage conflict such that a conflict does not occur between multiple remote downhole tools. The conflict may be a communication conflict. The communication conflict may be due to the controller receiving data transmissions from multiple remote downhole tools and/or due to the controller transmitting control signals to multiple remote downhole tools.

In some or more examples, the controller is configured to at least one of: assign communication channels to the remote downhole tools; and time delay communication with the remote downhole tools. The controller may be configured to transmit a control signal to at least one remote downhole tool to assign a communication channel to the remote downhole tool. The controller may assign a separate channel to each remote downhole tool to manage conflict. Each remote downhole tool which communicates with the controller, i.e. receives a control signal from the controller or transmits data to the controller, may be assigned a separate and/or unique communication channel. The communication channel may comprise a frequency or frequency range, a wavelength, a time range, and/or a particular wire/cable.

The controller may be configured to delay transmission of the control signal such that sufficient time has elapsed between transmission of temporally concurrent control signals to manage conflict. The controller may be configured to delay reception of data from remote downhole tools such that sufficient time has elapsed between reception of temporally concurrent data to manage conflict.

In some or more examples, the controller is configured to implement channel spacing to manage conflict. The controller may be configured to assign a separate and unique channel to each remote downhole tool to which a control signal is transmitted. The channels may be sufficiently spaced such that conflicts may be managed.

In some or more examples, the remote downhole tool is configured to change between any of data transmission in response to the control signal, the event at the remote downhole tool and on the schedule.

In some or more examples, the event is a power condition at the remote downhole tool, or a parameter at a threshold level. The power condition may be low power at one or more batteries powering the downhole tool. The parameter may be detected by the downhole tool. The parameter may be one or more pressure, temperature, strain, stress, resistivity, current, and voltage.

In some or more examples, data comprises data collected by one or more sensors of the remote downhole tool. At least one of the sensor may detect one or more of pressure, temperature, strain, stress, resistivity, current, and voltage downhole.

In some or more examples, the schedule comprises data transmission at least once every 24 hours. In some or more examples, the schedule comprises data transmission once every hour, or once every 3, 4 or 6 hours. Transmitting data according to schedule ensures that data collected by the remote downhole tool is transmitted to surface regularly. This may result in the remote downhole tool requiring smaller storage, e.g. memory storage, to store detected data as data is regularly transmitted from the remote downhole tool.

In some or more examples, the remote downhole tool further comprises a detector configured to detect a power level of at least one battery at the remote downhole tool. The battery is configured to power the downhole tool. Upon the detector detecting that the battery has reaching a power condition, such as a power level being below a threshold power level, the downhole tool may communicate data detected at the downhole tool. This ensures that data is not lost, but instead communicated prior to the downhole tool having insufficient power to communicate detected data.

According to another aspect of the disclosure there is provided a method of managing data transmission of a remote downhole tool via a controller. The controller is configured for use at surface or uphole of the remote downhole tool.

Managing data transmission of a remote downhole tool via a controller configured for use at surface or uphole of the remote downhole tool ensures that data, such as measurements made by the downhole tool, are transmitted as and when needed. Further, the remote downhole tool may have less logic and/or electronics than conventionally required for the downhole tool to control transmission of data. As such, the remote downhole tool may have reduced power requirements compared to conventional downhole tools given the reduction in logic and/or electronics. If the remote downhole tool is battery powered, then the remote downhole tool may have a longer service life before battery replacement is required as the battery may power the downhole tool for a greater period of time and/or the remote downhole tool may be smaller than conventional downhole tools.

In some or more examples, the method may comprise transmitting a control signal from a controller to a remote downhole tool to control transmission of data from the remote downhole tool to the controller. The control signal may be configured to configure the tool for transmission of data from the remote downhole tool according to a schedule or on demand. The control signal may comprise data for configuring the downhole tool to transmit data according to the schedule and/or on demand.

In some or more examples, the method further comprises changing from transmission of data according to the schedule and on demand. In some or more examples, the schedule comprises data transmission once every 24 hours, once every hour, or once every 3, 4 or 6 hours. Transmitting data according to schedule ensures that data collected by the remote downhole tool is transmitted to surface regularly. This may result in the remote downhole tool requiring smaller storage, e.g. memory storage, to store detected data as data is regularly transmitted from the remote downhole tool.

In some or more examples, the method further comprises receiving data from the remote downhole tool at a receiver according to the schedule or on demand. In some or more examples, the method further comprises transmitting data alternatively or additionally to an uphole or downhole unit. In some or more examples, the unit is located at the surface or is located at a subsea location, e.g. at the surface of the sea floor.

In some or more examples, the method further comprises receiving data from the remote downhole tool in response to an event at the remote downhole tool. In some or more examples, the event is a power condition at the downhole tool, or a parameter at a threshold level. The power condition may be low power at one or more batteries powering the downhole tool. The parameter may be detected by the downhole tool. The parameter may be one or more pressure, temperature, strain, stress, resistivity, current, and voltage.

In some or more examples, the method further comprises managing conflict between data transmission from more than one remote downhole tools. The conflict may be a communication conflict. The communication conflict may be due to the controller receiving data transmissions from multiple remote downhole tools and/or due to the controller transmitting control signals to multiple remote downhole tools.

In some or more examples, managing conflict comprises at least one of: assigning communication channels to the remote downhole tools; and time delaying communication with the remote downhole tools. The method may comprises transmitting a control signal to at least one remote downhole tool to assign a communication channel to the remote downhole tool. The method may comprises assigning a separate channel to each remote downhole tool to manage conflict. Each remote downhole tool which communicates with the controller, i.e. receives a control signal from the controller or transmits data to the controller, may be assigned a separate and/or unique communication channel. The communication channel may comprise a frequency or frequency range, a wavelength, a time range, and/or a particular wire/cable.

In some or more examples, the method further comprises delaying transmission of the control signal such that sufficient time has elapsed between transmission of temporally concurrent control signals to manage conflict. The method may comprise delaying reception of data from remote downhole tools such that sufficient time has elapsed between reception of temporally concurrent data to manage conflict.

In some or more examples, the method may further comprise implementing channel spacing to manage conflict. Channel spacing may comprise assigning a separate and unique channel to each remote downhole tool to which a control signal is transmitted. The channels may be sufficiently spaced such that conflicts may be managed.

According to another aspect of the disclosure there is provided a method of managing data transmission of a remote downhole tool for use with a controller, the remote downhole tool located downhole of the controller.

Managing data transmission of a remote downhole tool for use with a controller, the remote downhole tool located downhole of the controller ensures that data, such as measurements made by the downhole tool, are transmitted as and when needed. Further, the remote downhole tool may have less logic and/or electronics than conventionally required for the downhole tool to control transmission of data. As such, the remote downhole tool may have reduced power requirements compared to conventional downhole tools given the reduction in logic and/or electronics. If the remote downhole tool is battery powered, then the remote downhole tool may have a longer service life before battery replacement is required as the battery may power the downhole tool for a greater period of time and/or the remote downhole tool may be smaller than conventional downhole tools.

In some or more examples, the method comprises transmitting data from a remote downhole tool in response to at least one of a control signal from a controller to control transmission of data from the remote downhole tool, an event at the remote downhole tool and on a schedule.

In some or more examples, the method further comprises changing between any of transmission in response to the control signal, the event at the remote downhole tool and on the schedule.

In some or more examples, the method further comprises detecting occurrence of the event at the remote downhole tool.

In some or more examples, detecting comprises detecting a power condition at the remote downhole tool.

In some or more examples, the method comprises receiving the control signal from the controller to configure the tool for transmission of data from the remote downhole tool.

According to another aspect of the disclosure, there is provided a computer-readable medium comprising instructions that, when executed by a processor, perform any of the described methods.

The computer-readable medium may be non-transitory. The computer-readable medium may comprise storage media excluding propagating signals. The computer-readable medium may comprise any suitable memory or storage device such as random-access memory (RAM), static RAM (SRAM), dynamic RAM (DRAM), non-volatile RAM (NVRAM), read-only memory (ROM), or Flash memory.

The processor may have a single-core processor or multiple core processors composed of a variety of materials, such as silicon, polysilicon, high-K dielectric, copper, and so on.

It should be understand that any features described in relation to one aspect, example or embodiment of the disclosure may also be used in relation to any other aspect or embodiment of the disclosure.

Other advantages of the present disclosure will become apparent to a person skilled in the art from the detailed description in association with the following drawings.

BRIEF DESCRIPTION OF THE DRAWINGS

A description is now given, by way of example only, with reference to the accompanying drawings, in which.

DETAILED DESCRIPTION OF THE INVENTION

Figure 1:
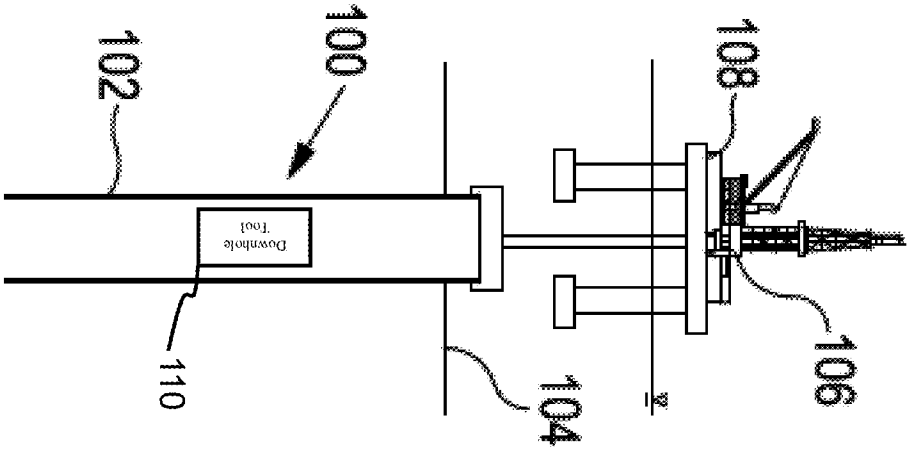
FIG. 1 is a simplified representation of a well structure with a downhole tool.

The foregoing summary, as well as the following detailed description of certain embodiments will be better understood when read in conjunction with the accompanying drawings. As will be appreciated, like reference characters are used to refer to like elements throughout the description and drawings. As used herein, an element or feature recited in the singular and preceded by the word "a" or "an" should be understood as not necessarily excluding a plural of the elements or features. Further, references to "one example" or "one embodiment" are not intended to be interpreted as excluding the existence of additional examples or embodiments that also incorporate the recited elements or features of that one example or one embodiment. Moreover, unless explicitly stated to the contrary, examples or embodiments "comprising", "having" or "including" an element or feature or a plurality of elements or features having a particular property might further include additional elements or features not having that particular property. Also, it will be appreciated that the terms "comprises", "has" and "includes" mean "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of describing the relationship of an element or feature to another element or feature as depicted in the figures. The spatially relative terms can however, encompass different orientations in use or operation in addition to the orientation depicted in the figures.

Reference herein to "example" means that one or more feature, structure, element, component, characteristic and/or operational step described in connection with the example is included in at least one embodiment and or implementation of the subject matter according to the present disclosure. Thus, the phrases "an example," "another example," and similar language throughout the present disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to".

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, or within less than 0.01% of the stated amount.

Some of the following examples have been described specifically in relation to well infrastructure relating to oil and gas production, or the like, but of course the systems and methods may be used with other well structures. Similarly, while in the following example an offshore well structure is described, nevertheless the same systems and methods may be used onshore, as will be appreciated.

Turning now to FIG. 1, a simplified representation of a section of a well 100 is shown. In this embodiment, the well 100 is an offshore well, although a person skilled in the art will appreciate that the well 100 may be another type of well. A well structure 102 extends from the surface to a subterranean formation. In this embodiment, the surface is the seabed or mudline 104. The well structure 102 may comprise a conductor, casing and other tubing used to recover product from the subterranean formation. The well 100 further comprises a wellhead 106, wet tree or the like, at a production platform 108. In other embodiments, the wellhead 106 is located at the mudline 104.

As a person skilled in the art will appreciate, the well 100 may further comprise an open hole section, in that there is no well structure positioned within the well 100 in the open hole section as shown in FIG. 1, or be terminated. The open hole structure may be lower than the well structure. The open hole structure may be located above the well structure 102. Similarly, a person skilled in the art will appreciate that the well 100 may be any one of a production well, injection well, appraisal well or a side track of an existing well.

As shown in FIG. 1, a downhole tool 110 is positioned within the well structure 102. The downhole tool 110 is positioned in the well structure 102 by one or more of hangers, clamps, friction fit, setting tools, etc. The downhole tool 110 may be positioned within the well structure 102 as shown in FIG. 1, or below the open well structure 102 in an open well section.

As further shown in FIG. 1, a controller 120 uphole of the downhole tool 110 such that the downhole tool 110 is remote or downhole from the controller 120. The controller 120 is located at the production platform 108, although the controller 120 may be located at the mudline 104, at some other location at surface, or within the well structure 102. The controller 120 is for use in controlling transmission of data from the downhole tool 110 as will be described. In particular, the controller is configured to transmit a control signal to the downhole tool 110 to configure the downhole tool 110 for transmission of data from the downhole tool 110 according to a schedule or on demand.

While only a single downhole tool 110 is shown in FIG. 1, multiple downhole tools may be present in the structure 102 and in an open hole section. Furthermore, the controller 120 may be configured to control transmission of data from more than one downhole tool 110.

Figure 2:
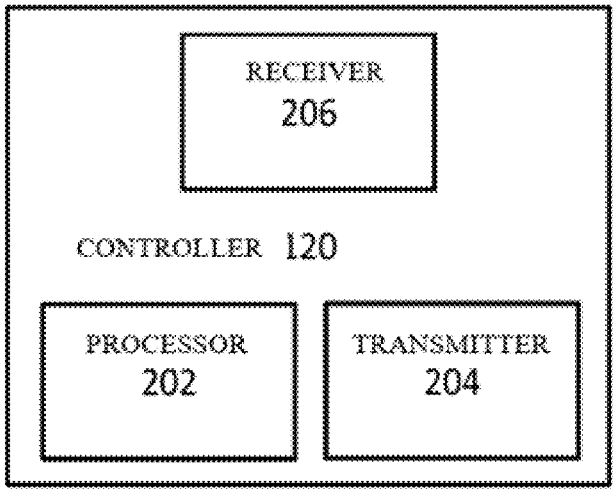
FIG. 2 is a simplified block diagram of a controller.

Turning now to FIG. 2, a simplified block diagram of the controller 120 is shown. The controller 120 is configured for use uphole from the downhole tool 110. The controller 120 is for transmission of control signals to the downhole tool 110 to control transmission of data from the downhole tool 110. In this manner, the downhole tool 110 does not require additional circuitry to determine when to transmit data, but is simply controlled by control signals from the controller 110. This may increase space available to other components in the downhole tool 110 such as batteries, or sensors and gauges. Furthermore, the reduced processing performed at the downhole tool 110 reduces the power required thereby decreases the size of the required batteries, and/or increasing the batter life of the downhole tool 110. The controller 120 comprises a processor 202, a transmitter 204 and a receiver 206. The processor 202, transmitter 204 and receiver 206 are in electrical communication with each other.

In general, the processor 202 is for controlling the transmitter 204 and receiver 206. The processor 202 may also be configured to process received data from the downhole tool 110. In particular, the processor 202 may process input received at controller 120, such as automated instructions (i.e. instructions that do not require operator input) or operator trigged instructions, and control the transmitter 204 and/or receiver 206 based on these inputs. The processor 202 controls operation of the transmitter 204 to transmit control signals to the downhole tool 110. The processor may further control operation of the receiver 206 to receive data, such as data transmitted by the downhole tool 110.

The processor 202 may be configured to control the transmitter 204 and/or receiver 206 to manage conflict between one or more downhole tools 110. Such conflicts may arise due to multiple data transmissions being received by the receiver 206 and/or because multiple control signals being transmitted by the transmitter 204 to one or more downhole tools 110. In some instances, the processor 202 controls the transmitter 204 and receiver 206 to assign communication channels to one or more downhole tools 110. Alternatively, or in addition, the processor 202 may control the transmitter 204 and receiver 206 to time delay communication with the downhole tools 110 (i.e. transmission to and reception from the downhole tool 110). Furthermore, the processor 202 may implement channel spacing for the downhole tools 110.

The transmitter 204 is for transmitting control signals to the downhole tool 110. In particular, the transmitter 204 is for transmitting control signals to the downhole tool 110 to configure the downhole tool 110 for transmission of data from the downhole tool 110 according to a schedule or on demand. The control signals may comprise data for configuring the downhole tool to transmit data according to the schedule and/or on demand. The transmitter 204 may transmit control signals to the downhole tool 110 wirelessly and/or via wired communication. Wired connection may include use dedicated cabling or wireline between the controller 120 and the downhole tool 110. Wireless communication may involve use of acoustic and/or electromagnetic waves. The transmitter 204 may use technologies such as applicant's CaTS™ system that transmits signals using electromagnetic waves between the controller 120 and the downhole tool 110 utilizing well tubing, structures, or casing as a transmission medium (e.g. structure 102). Alternatively, data may be transmitted using other wireless methods such as (but not limited to) by acoustic signals or with flow modulation techniques.

The receiver 206 is for receiving data. The receiver 206 may receive data from the downhole tool 110. As such, the receiver 206 may be configured to accept data from downhole tool 110. The receiver 206 may receive data from the downhole tool 110 on a schedule or on demand by the controller 110, i.e. the controller 110 demands data from the downhole tool 110 by transmitting a control signal to the downhole tool to configure the downhole tool 110 for transmission of data from the downhole tool 110 according to a schedule or on demand. The processor 202 may configure the receiver to accept data from one or more downhole tools to which the controller 110 has sent a control signal to configure the tool 110 for transmission of data according to a schedule or on demand.

While the transmitter 204 and receiver 206 have been described separately, they may be incorporated into a single transceiver providing the described functionality. Furthermore, the processor 202 may be separate from the transmitter 204 and receiver 206, or incorporated thereto.

Figure 3:
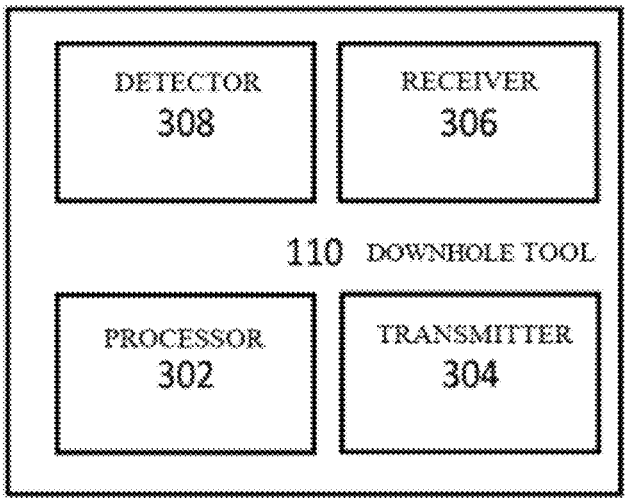
FIG. 3 is a simplified block diagram of a downhole tool.

Turning now to FIG. 3, a block diagram of the downhole tool 110 is shown. The downhole tool 110 comprises a processor 302, a transmitter 304 and a receiver 306. The processor 302, transmitter 304 and receiver 306 are in electrical communication with each other.

The processor 302 is for controlling the transmitter 304 and receiver 306. The processor 302 may process control signals received by the receiver 306 and instruct the transmitter 304 accordingly. In particular, the receiver 306 may receive a control signal from the controller 120 to configure the tool 110 for transmission of data from the downhole tool 110 according to a schedule or on demand. If the control signal received from the controller 120, in particular the transmitter 204 of the controller 120, requests transmission of data on demand, then the transmitter 304 may transmit data from the downhole tool 110 in response to the control signal. If the control signal received from the controller 120, in particular the transmitter 204 of the controller 120, requests transmission of data on a schedule, then the transmitter 304 may transmit data from the downhole tool 110 on the schedule. The schedule may be once every 24 hours, once every hour, 3, 4 or 6 hours, or some other time interval, regular or irregular.

The transmitter 304 and receiver 306 may communicate using wired or wireless communication as previously described. The transmit 304 may transmit data to the controller 110 and/or to some other location.

The downhole tool 110 may be configured to transmit collected data according to an event at the downhole tool. In one example, the downhole tool 110 comprises a detector 110 for detecting an event at the downhole tool 110. The detector 308 may be in electrical communication with the other features of the downhole tool and may be configured to detect a parameter reaching a threshold level.

For example, the detector 308 may detect a power level of one or more batteries at the downhole tool 110. In response to detecting a low power level, i.e. detecting a power level passing a threshold, the detector 308 may generate a signal which, when processed at the processor 302, instructs the transmitter 304 to transmit data to the controller 110.

In another example, the parameter is pressure, temperature, strain, stress, resistivity, current and voltage detected at the downhole tool 110.

The downhole tool 110 may further comprises one or more sensors and/or gauges that detect/collect data at the downhole tool 110. Such data may include pressure, temperature, strain, stress, resistivity, current, and voltage information. Such data may be stored at the downhole tool 110. Such data may be transmitted by the receiver 306 to a remote location such as to the controller 110 on demand, on a schedule or in response to an event at the downhole tool 110.

The processors 202, 302 may comprise microprocessor(s) and computer-readable storage media (CRM). The microprocessor may be a single core processor or a multiple core processor composed of a variety of materials, such as silicon, polysilicon, high-K dielectric, copper, and so on. The CRM described herein excludes propagating signals. The CRM may include any suitable memory or storage device such as random-access memory (RAM), static RAM (SRAM), dynamic RAM (DRAM), non-volatile RAM (NVRAM), read-only memory (ROM), or Flash memory. Furthermore, the transmitters 204, 304 and/or receivers 206, 306 may comprise one or more short-range or long-range modems.

The downhole tool 110 and controller 120 may form a communication system for use in a downhole environment. The communication system may comprises multiple downhole tool 110.

Figure 4:
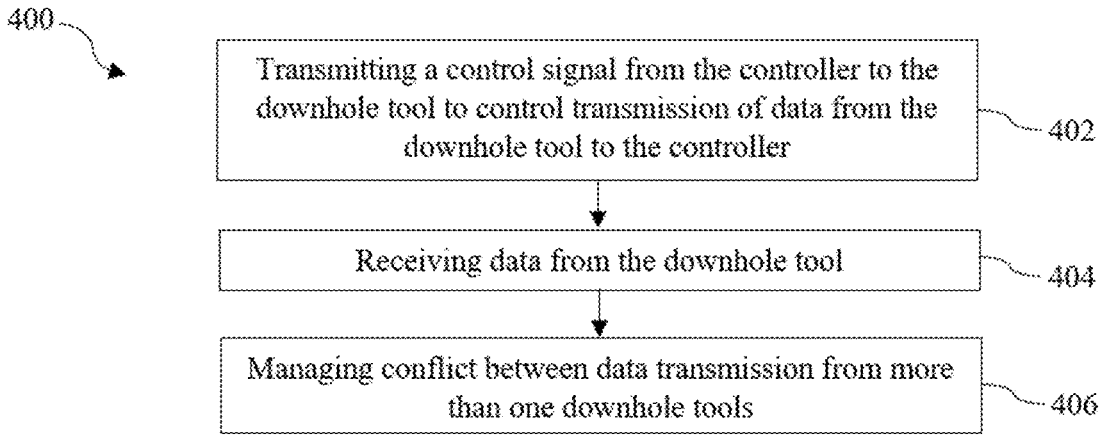
FIG. 4 is a flowchart of a method of managing data transmission of a downhole tool via a controller.

Operation of the controller 120 is shown in the flowchart of FIG. 4 generally identified as reference numeral 400. The method 400 comprises transmitting 402 a control signal from the controller 120 to the downhole tool 110 to control transmission of data from the downhole tool 110 to the controller 120. As previously described, the control signal is configured to configure the tool 110 for transmission of data from the downhole tool 110 according to a schedule or on demand. In particular transmitting 402 comprises instructing, via the processor 202, the transmitter 204 to transmit the control signal to the receiver 306 of the downhole tool 110.

The receiver 306 receives the control signal and instructs, via the processor 302 of the downhole tool 110, the transmitter 304 to transmit data on demand or according to a schedule.

Transmitting 402 the control signal may include changing from transmission of data according to a schedule and on demand. For example, the downhole tool 110 may be transmitting data according to a schedule and then change to transmitting on demand based on a change in wellbore lifecycle, e.g. from production to abandonment.

The method 400 further comprises receiving 404 data from the downhole tool 110. In particular, data is transmitted by the transmitter 304 of the downhole tool 110 and received at the receiver 206 of the controller 120. Data may be received on a schedule, on demand or in response to an event detected at the downhole tool 110.

The method 400 may further comprise managing 406 conflict between data transmission from more than one downhole tools 110. Managing 406 conflict may comprise at least one of: assigning communication channels to downhole tools; and time delaying communication with downhole tools.

Figure 5:
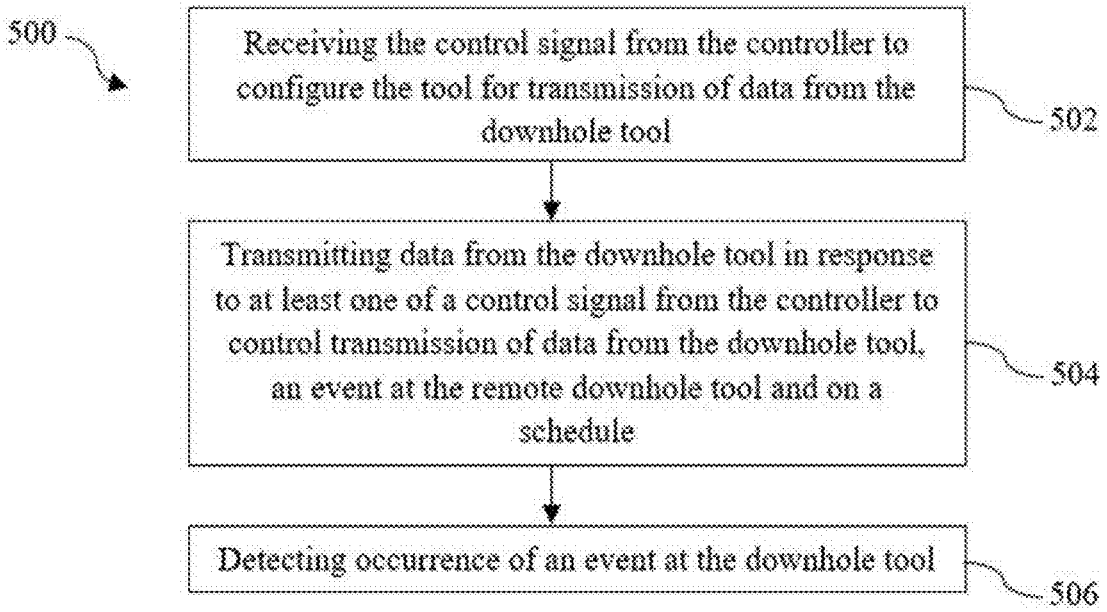
FIG. 5 is a flowchart a method of managing data transmission of a downhole tool for use with a controller.

Operation of the downhole tool 110 is shown in the flowchart of FIG. 5 generally identified as reference numeral 500. The method 500 comprises transmitting 504 data from the downhole tool 110 in response to at least one of a control signal from the controller 120 to control transmission of data from the downhole tool 110, an event at the remote downhole tool and on a schedule. In particular, the method 500 comprises transmitting 504 data via the transmitter 304 to the receiver 206 of the controller 120.

The method may comprise changing between any of transmission in response to the control signal, the event at the downhole tool 110 and on the schedule.

The method may further comprise detecting 506 occurrence of an event at the downhole tool 110. Detecting 506 may comprise detecting a power condition at the downhole tool 110.

Prior to transmitting 504 data from the downhole tool 110, the method 500 may comprise receiving 502 the control signal from the controller 120 to configure the tool 110 for transmission of data from the downhole tool 110.

The applicant hereby discloses in isolation each individual feature described herein and any combination of two or more features, to the extent that such features or combinations are capable of being carried out based on the present specification as a whole in the light of the common general knowledge of a person skilled in the art, irrespective of whether such features or combination of features solve any problems disclosed herein, and without limitation to the scope of the claims. The applicant indicates that aspects of the disclosure may consist of any such individual feature or combination of features. In view of the foregoing description it will be evident to a person skilled in the art that various modifications may be made within the scope of the disclosure.

The invention claimed is:

1. A controller for use with a first remote downhole tool of a plurality of downhole tools, the controller comprising a processor, a transmitter for transmission of control signals to the first remote downhole tool, and a receiver for reception of data from the first remote downhole tool, the controller configured for use at surface or uphole of the first remote downhole tool to control transmission of data from the first remote downhole tool, wherein the controller is configured to transmit a control signal to the first remote downhole tool to configure the first remote downhole tool for transmission of data from the first remote downhole tool according to a schedule or on demand, wherein the controller is configured to configure the receiver to accept transmission of data from the plurality of remote downhole tools to which the controller has transmitted a control signal to configure the plurality of remote downhole tools for transmission of data according to the schedule and wherein the controller is configured to manage conflict between more than one remote downhole tool of the plurality of remote downhole tools and wherein the controller is configured to time delay communication with the plurality of remote downhole tools.

2. The controller of claim 1, wherein the controller is configured to control transmission of data from the plurality of remote downhole tools.

3. The controller of claim 2, wherein the controller is configured to:

assign communication channels to the plurality of remote downhole tools.

4. A communication system for use in a downhole environment, the communication system comprising:

a controller according to claim 1; and the first remote downhole tool configured to transmit data to the controller, wherein the first remote downhole tool is configured to transmit data in response to the control signal from the controller, an event at the first remote downhole tool and on the schedule.

5. The communication system of claim 4, wherein the first remote downhole tool is configured to change between any of data transmission in response to the control signal, the event at the first remote downhole tool and on the schedule.

6. The communication system of claim 4, wherein the event is a power condition at the first remote downhole tool, or a parameter at a threshold level.

7. The communication system of claim 4, wherein data comprising data collected by one or more sensors of the first remote downhole tool is transmitted to the controller and/or wherein the schedule comprises data transmission at least once every 24 hours.

8. The communication system of claim 4, wherein the first remote downhole tool further comprises a detector configured to detect a power level of at least one battery at the first remote downhole tool.

9. A method of managing data transmission of a first remote downhole tool of a plurality of downhole tools for use with a controller, the first remote downhole tool located downhole of the controller, the method comprising:

configuring a receiver of the controller to accept transmission of data from the plurality of remote downhole tools to which the controller has transmitted a control signal to configure the plurality of remote downhole tools for transmission of data according to a schedule;

transmitting data from the first remote downhole tool in response to at least one of the control signal from the controller to control transmission of data from the first remote downhole tool, an event at the first remote downhole tool and on the schedule; and managing conflict between data transmission from more than one remote downhole tool of the plurality of downhole tools, wherein managing conflict comprises time delaying communication with the plurality of remote downhole tools.

10. The method of claim 9, further comprising changing between any of transmission in response to the control signal, the event at the first remote downhole tool and on the schedule.

11. The method of claim 9, further comprising detecting occurrence of the event at the first remote downhole tool and wherein the detecting comprises detecting a power condition at the first remote downhole tool.

12. The method of claim 9, receiving the control signal from the controller to configure the first remote downhole tool for transmission of data from the first remote downhole tool.

13. The method of claim 9, further comprising:

transmitting the control signal from the controller to the first remote downhole tool to control transmission of data from the first remote downhole tool to the controller, the control signal configured to configure the first remote downhole tool for transmission of data from the first remote downhole tool according to the schedule or on demand.

14. The method of claim 13, further comprising changing from transmission of data according to the schedule and on demand.

15. The method of claim 13, further comprising receiving data from the first remote downhole tool at a receiver according to the schedule or on demand.

16. The method of claim 13, further comprising receiving data from the first remote downhole tool in response to an event at the first remote downhole tool.

17. The method of claim 13, wherein managing conflict comprises:

assigning communication channels to the plurality of remote downhole tools.

18. A non-transitory computer-readable medium comprising instructions that, when executed by a processor, perform the method of claim 13.

* * * * *